United States Patent [19]

Clark et al.

[11] 4,047,942

[45] Sept. 13, 1977

[54] THERMITE SMELTING OF FERROMOLYBDENUM

[75] Inventors: George W. Clark, Stonham Aspal; Douglas H. Dainty, Bury St. Edmunds, both of England

[73] Assignee: AMAX Inc., Greenwich, Conn.

[21] Appl. No.: 727,879

[22] Filed: Sept. 29, 1976

[51] Int. Cl.[2] ..... C22B 5/04

[52] U.S. Cl. ..... 75/133.5; 75/27

[58] Field of Search ..... 75/27, 133.5

[56] References Cited

U.S. PATENT DOCUMENTS

| | | | |
|---|---|---|---|
| 1,437,272 | 11/1922 | Skelley et al. | 75/133.5 |
| 3,740,199 | 6/1973 | Gammill et al. | 75/27 |

FOREIGN PATENT DOCUMENTS

| | | | |
|---|---|---|---|
| 184,843 | 8/1922 | United Kingdom | 75/27 |

*Primary Examiner*—M. J. Andrews

*Attorney, Agent, or Firm*—Harness, Dickey & Pierce

[57] ABSTRACT

A process for producing ferromolybdenum alloys by thermite smelting of a particulated reaction mixture composed of a molybdenum oxide concentrate, an iron bearing material, a reductant and a slag fluxing agent present in controlled proportions. The reaction mixture is progressively charged into a refractory crucible and is exothermically reacted to produce a molten mass of ferromolybdenum alloy having a molten layer of slag floating on the upper surface thereof. The charging of the reaction mixture is interrupted for prescribed time intervals to permit the mass of ferromolybdenum alloy to solidify, and optionally, to permit a withdrawal of the major portion of the molten slag layer from the upper stratum thereof, whereby a multi-layered ingot is produced comprising layers of metallic ferromolybdenum separated by intervening residual slag layers.

10 Claims, 4 Drawing Figures

THERMITE SMELTING OF FERROMOLYBDENUM

BACKGROUND OF THE INVENTION

Ferromolybdenum is in widespread commercial use as an alloying addition agent in steelmaking and other metallurgical operations. Ferro-alloys of molybdenum conventionally contain from about 60% up to about 75% by weight molybdenum and are commercially produced employing batch-type operations, either by a thermite process or by an electric furnace reduction process. Both of these techniques are labor and energy intensive and various alternative techniques have heretofore been proposed for use to increase the efficiency of such processes in order to reduce the costs of the ferro alloy produced.

Ferromolybdenum alloys are principally produced commercially by the so-called thermite process by which ingots or buttons of the alloy can be produced in sizes up to about 2,000 pounds. Typically, a thermite reaction mixture is comprised of about 1,300 pounds of contained molybdenum in the form of the oxide, 116 pounds of 98% aluminum, 1,122 pounds of 50% ferrosilicon, 618 pounds of a high-grade iron ore, 160 pounds of limestone and 50 pounds of high-grade fluorspar. The particulated reaction mixture is placed in a refractory lined steel-backed crucible positioned over a shallow pit of sand, over which a dust hood is placed and the reaction is started by igniting the charge with a starting fuse. This so-called top-fired thermite smelting reaction is rapid and the fumes and dust are withdrawn from the dust hood through a bag filter for recovery of fines and for post-treatment of the fumes in order that they can harmlessly be discharged to the atmosphere. The thermite reaction is usually complete in about 20 minutes, whereupon the crucible is lifted and the mass of molten ferromolybdenum alloy and overlying molten slag layer are allowed to solidify, whereafter the slag layer is removed and the so-called ferro-alloy button crushed and thereafter screened to the desired particle size range consistent with its intended end use.

Problems associated with the aforementioned prior art top-fired thermite smelting process include the limitation on the quantity of ferro-alloy that can be produced during each heat and the relatively high percentage of valuable molybdenum constituents entrapped in the lower and upper layers of the slag as a function of the total surface area of the slag layer which usually necessitates a post-treatment of the slag to recover the molybdenum values therein. The necessity of producing such ingots or buttons within a relatively narrow range of thicknesses to avoid undesirable variations in composition and to enable subsequent crushing into a particulate product using commercially available crushing equipment has also handicapped the quantity of ferromolybdenum alloy that can be produced in a crucible.

The present process overcomes many of the disadvantages associated with prior art techniques by increasing the proportionate yield of ferro-alloy for a given volume of crucible, by reducing the magnitude of molybdenum values entrapped in the slag layer and by proportionately decreasing the labor and energy requirements per unit weight of ferro-alloy produced.

SUMMARY OF THE INVENTION

The benefits and advantages of the present invention are achieved by a process including the steps of forming a substantially uniform particulated reaction mixture composed of molybdenum oxide, an iron bearing material such as a high grade iron ore, a reductant and a slag fluxing agent which are present in controlled proportions. In accordance with a preferred embodiment of the present invention, the reductant comprises a mixture of silicon and metallic aluminum present in proportions on a weight ratio basis of about 4:1 to about 10:1 parts silicon for each part aluminum, and wherein the total reducant is present in an amount substantially equal or slightly in excess of that stoichiometrically required to react with the oxygen associated with the molybdenum oxide and iron bearing constituents in the reaction mixture. An initial portion of the reaction mixture is charged into a refractory-lined crucible and is ignited by a suitable fuse to initiate the exothermic thermite reaction with a second portion of the mixture being progressively added and reacted so as to form a molten mass of ferromolybdenum having a layer of molten slag floating across the upper surface thereof. The reaction mixture is fired and after a suitable settling period, such as 40 – 45 minutes, droplets or prills formed in the slag mass have settled and entered the molten ferromolybdenum mass. At the conclusion of the settling period, the predominant portion of slag is preferably withdrawn from the upper stratum of the slag layer. After a cooling period, such as a period of 1 – 6 hours, to effect a solidification of the ferro-alloy mass, an additional reaction mixture is added and a second reaction commenced. The intermittent withdrawal of the predominant portions of molten slag in accordance with the preferred embodiment of this invention increases the effective volume of the crucible and the successive reactions are repeated until substantially the entire crucible has been filled.

The resultant reaction mass is thereafter cooled to effect a solidification thereof, and the multi-layered ingot comprising layers of ferromolybdenum alloy of controlled thickness separated by intervening residual slag layers is cleaved to enable removal of the slag sections, and the individual ferro-alloy buttons are crushed and screened to sizes consistent with the intended end use of the ferro-alloy. The molten slag portions withdrawn from the crucible are substantially devoid of any entrapped molybdenum values and can be discharged to waste, while the relatively thin layers of residual slag between layers of the ferro-alloy can be advantageously processed for recovery of the entrapped molybdenum values therein. The presence of residual slag layers in the ingot also facilitates cleavage of the multi-layered ingot into individual ferro-alloy buttons which may be further enhanced by the addition of refractory materials to the residual slag layers between succeeding reactions.

Additional benefits and advantages of the present invention will become apparent upon a reading of the description of the preferred embodiments taken in conjunction with the accompanying drawing, and the typical examples provided.

DESCRIPTION OF THE PREFERRED EMBODIMENTS

Figure 1:
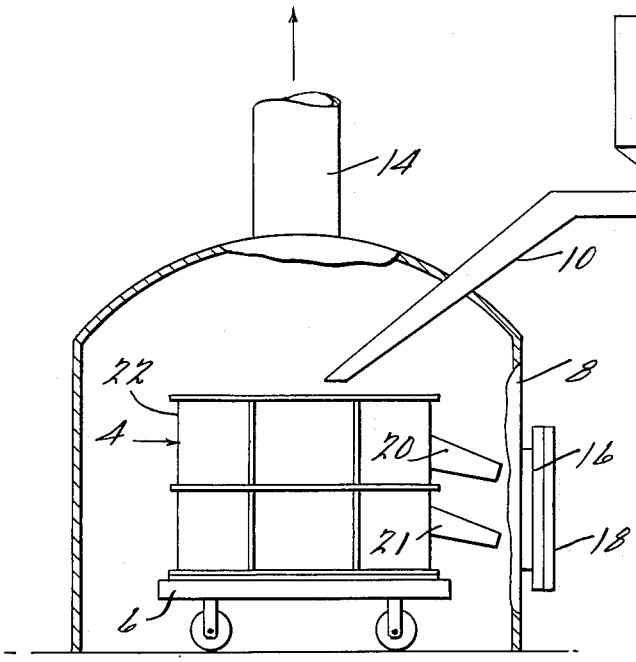
FIG. 1 is a schematic view of a refractory-lined crucible positioned within a smoke and dust collection chamber preparatory to the thermite reaction process.

The particulated reaction mixture is composed of controlled amounts of a molybdenum oxide concentrate, and iron bearing material, a reductant, and a slag fluxing agent. The proportions of molybdenum oxide and iron bearing material are controlled so as to provide the desired concentration of molybdenum in the resultant smelted ferromolybdenum alloy, which usually is controlled for most commercial uses to provide a molybdenum content ranging from about 60% up to about 75% by weight. The molybdenum bearing constituent of the reaction mixture may conveniently comprise a finely-particulated free-flowing powder concentrate composed predominantly of molybdenum trioxide, and preferably consists of a so-called technical grade molybdenum oxide concentrate containing at least about 90% by weight molybdenum trioxide and having an average particle size of less than about 100 mesh (149 microns) to as small as about 1 micron.

Molybdenum oxide concentrates of the foregoing type are conventionally produced by roasting molybdenite ($MoS_2$) concentrates at an elevated temperature, such as 600° C, in the presence of excess air in a multiple-hearth furnace, such as a Herreschoff, McDougall, Wedge, Nichols, etc. Any agglomerates formed during the air roasting operation are readily removed by subjecting the roasted molybdenum oxide concentrate to a preliminary grinding operation to effect a reduction in its particle size to within the desired range. Technical grade concentrates usually contain about 94% to about 95% by weight molybdenum trioxide, with the remainder composed predominantly of silicates and other contaminating constituents present in the original molybdenite ore body. While higher purity molybdenum trioxide feed materials can also be satisfactorily employed, such as produced by purification processes employing precipitation, crystallization, filtration and drying or calcination to reduce the concentration of contaminating constituents therein, the higher cost of such high purity grades ordinarily is undesirable for economic reasons.

In addition to the molybdenum trioxide concentrate, the molybdenum constituent of the reaction mixture may also include the fines or dust recovered during prior smelting operations which contain substantial amounts of molybdenum trioxide, as well as the other elements of which the reaction mixture is comprised. Additionally, the reaction mixture can include molybdenum values recovered from a post-treatment of the residual slag layer from prior heats which is in the form of a powder of a size so as to enable a uniform blending thereof with the major molybdenum trioxide constituent and remaining particulated materials comprising the reaction mixture. Other sources containing molybdenum and molybdenum oxide values can also be employed, such as the tailings from a sublimation process for producing a purified molybdenum trioxide product.

The iron bearing constituent of the reaction mixture preferably comprises a high grade particulated iron ore as well as waste by-products rich in iron values ($Fe_2O_3$ and $Fe_3O_4$), such as mill scale and the like. The iron bearing material may also be comprised in part of metallic particulated ferrous scrap metal. A portion of the iron bearing material may be conveniently introduced in the form of a ferro-alloy of the reductant employed, such as ferrosilicon. In any event, the particle size of the iron bearing material is controlled so as to provide for a substantially uniform blending thereof with the molybdenum trioxide constituent, and is preferably controlled within an average particle size range from about 700 microns to about 60 microns. The quantity of the molybdenum trioxide and iron bearing materials in the reaction mixture are controlled so as to provide the desired ratio of molybdenum to iron as desired in the resultant ferromolybdenum alloy.

The reaction mixture additionally contains a reductant or combination of reductants which are present in a controlled amount so as to exothermically react with the molybdenum oxide and iron oxide constituents to effect a reduction thereof to the metallic state. The quantity of reductant used is calculated in accordance with that amount required to stoichiometrically react with the associated oxygen combined with the molybdenum and iron constituents or in slight stoichiometric excess thereof. The use of the reductant in excessive amounts is undesirable due to the presence of excessive amounts of the unreacted reductant in the resultant ferromolybdenum alloy produced.

While a variety of elements can theoretically be employed as the reductant such as, for example, calcium, magnesium, lithium, titanium, vanadium, manganese, chromium, etc., the use of controlled proportions of silicon and aluminum are preferred because of thermodynamic and kinetic considerations. particularly satisfactory results are obtained when silicon is employed as the primary reductant in combination with lesser quantities of aluminum as a secondary reductant to assure the completion of the exothermic reduction reaction at a commercially practical rate and the development of sufficient heat during the reaction to assure appropriate temperature of the reaction mass and proper fluidity of the slag layer. The quantity of aluminum employed is carefully controlled for economic reasons because of its relatively higher cost. The ratio of silicon to aluminum on a weight basis is preferably controlled within a range of from about 4:1 to about 10:1, providing optimum reaction conditions. The silicon constituent is preferably added in the form of a ferrosilicon alloy which is commercially available in a variety of grades, such as, for example, grades containing 90% silicon-10% iron; 75% silicon-25% iron; and 50% silicon-50% iron. The aluminum reductant can conveniently be added in the form of a finely-particulated metallic aluminum powder. It is also contemplated that the two reductants, or a portion thereof, can be added in the form of a powder of a ferrosilicon aluminum alloy which may nominally contain about 50% silicon, 7% aluminum, with the balance (43%) iron. The reductant is added in the form of a finely-particulated powder of an average particle size less than about 500 microns, and preferably of a size range ranging from about 400 microns to about 50 microns. The use of particle sizes within the aforementioned ranges facilitates a substantially uniform mixing of the reductant with molybdenum trioxide and iron bearing constituents, thereby providing the required surface area and distribution to assure uniformity and continuity of the exothermic reaction.

The reaction mixture further contains a controlled amount of a slag fluxing agent or combination of slag fluxing agents of the types known in the art which are employed for controlling the fluidity or viscosity of the molten slag layer to facilitate a settling and migration of metallic droplets or prills through the slag layer into the molten ferromolybdenum mass, thereby reducing entrapment of metal values in the slag layer. Fluxing agents of the types known in the art which can be satisfactorily employed for this purpose include fluorspar ($CaF_2$), limestone ($CaCO_3$), lime (CaO), which are commony employed for economic considerations. The quantity of fluxing agent or combination of fluxing agents employed is calculated in accordance with the composition of the reaction mixture such that the fluxing agents comprise from about 5% to about 20% by weight of the slag produced, and preferably about 10% of the slag weight. The fluxing agent is introduced in the form of a finely-particulated powder of an average particle size less than about 500 microns, and preferably from about 400 microns to about 50 microns to facilitate obtaining a substantially uniform blend with the reaction mixture and to facilitate a dissolution thereof in the molten slag layer as formed.

The formation of a substantially uniform blend of appropriate proportions of the several reaction constituents can be achieved utilizing mechanical blending or mixing equipment of the types well known in the art. The quantity of total reaction mixture prepared is calculated in consideration of the size of the ferromolybdenum alloy billet to be produced, the ratio of molybdenum to iron in the ferro-alloy, the quantity of associated oxygen in the molybdenum and iron bearing materials which determines the quantity of reductant required, and finally, the quantity of slag fluxing agents required to provide a desired concentration in the estimated volume of slag to be produced.

Referring now in detail to the drawing, as may be best seen in FIG. 1, a refractory-lined crucible 4 supported on a dolly cart 6 is adapted to be positioned within a smoke and dust collection chamber or hood 8 and is disposed so as to receive a charge of the reaction mixture from a chute 10 disposed in communication with the underside of a hopper 12 containing the blended particulated reaction mixture. The chamber or hood 8 is provided with a vent stack 14 which is connected to an exhaust system (not shown) including suitable filtration equipment, such as bag filters, for extracting the fines and other dust particles from the reaction gases evolved during the exothermic smelting operation. The collection chamber 8 is provided with a side port 16 provided with a removable hatch cover 18 for gaining access to the interior thereof and for periodically withdrawing molten slag from the crucible via one or a plurality of vertically spaced slag-tapping spouts indicated at 20 and 21.

Figure 2:
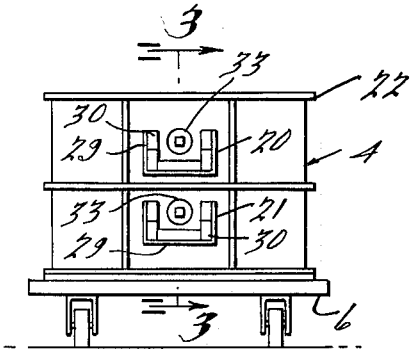
FIG. 2 is a side elevational view of the crucible shown in FIG. 1.
Figure 3:
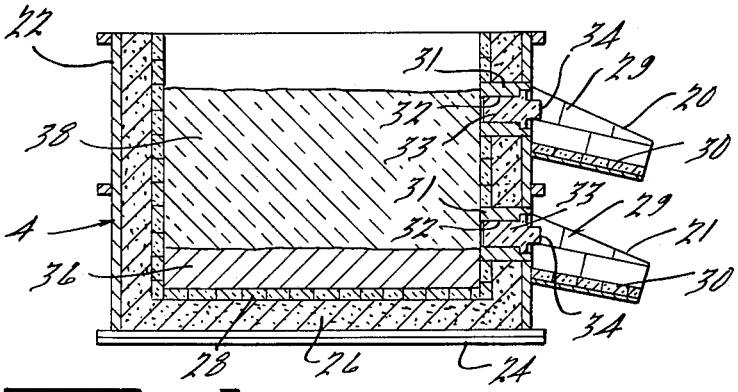
FIG. 3 is a transverse vertical sectional view through the refractory-lined crucible shown in FIG. 2 and taken along the line 3—3 thereof.

The refractory-lined crucible 4, as best seen in FIGS. 2 and 3, comprises a steel shell 22 formed with an annular flange around the lower base portion thereof, to which a base plate 24 is removably affixed. The inner surface and bottom of the steel shell 22 is lined with a layer of sand, indicated at 26, the interior of which is in turn lined with a plurality of refractory bricks 28. The refractory-lined crucible 4 may be of a rectangular or square horizontal cross sectional configuration, although circular or elliptical configurations are preferred because of the more uniform cooling rate of the ferro-alloy produced.

As shown in FIGS. 2 and 3, each of the slag-tapping spouts 20, 21 comprises a U-shaped steel chute 29 which is lined with a layer of refractory bricks 30 of the same type employed for lining the interior of the crucible 4. The steel shell 22 is formed with an opening adjacent to the slag-tapping spouts to accommodate a refractory box 31, which is formed with a stepped opening or port 32, which is adapted to receive a refractory stopper or plug 33. The outer end of the refractory plug 33 is formed with a projection or knob 34 to facilitate extraction of the plug at such time that a slag-tapping operation is to be performed. An improved sealing of the port 32 with a refractory plug 33 is achieved by applying a thin layer of refractory paste to the plug prior to insertion in the refractory box. An auxiliary brace (not shown) is normally employed to further retain the refractory plug in position during the thermite reaction process and which is readily removable to enable a removal of the plug.

The vertical disposition of the ports 32 of the slag-tapping spouts relative to the bottom layer of fire clay bricks in the lined crucible is controlled to provide an ingot or button of ferro-alloy of a controlled thickness and to further include an overlying residual slag layer in the order of about 2 inches. Ferromolybdenum allow buttons which are excessively thin are undesirable due to the differential cooling rates of the molten mass resulting in a heterogeneous composition of the resultant solidified mass. On the other hand, ferromolybdenum alloy buttons which are excessively thick are exceedingly difficult to handle and cannot be satisfactorily crushed or broken employing conventional commercially available crushing equipment. In accordance with the specific arrangement illustrated in section in FIG. 3, the lower portion of the interior of the crucible 4 is filled with a molten layer of ferromolybdenum alloy, indicated at 36, having a molten slag layer, indicated at 38, floating thereon. The vertical disposition of the slag-tapping spout is located at a position slightly above the interface between the surface of the ferromolybdenum alloy and the molten slag layer so as to enable a drainage of the major portion of molten slag at the completion of a prescribed dwell period to enable settling of any prills through the slag layer into the molten mass of ferro-alloy.

It is also contemplated that the crucible 4 may be provided with three or more slag-tapping spouts disposed at selected vertically spaced intervals to enable drainage of successive slag layers providing a multiple-layered ingot comprising a series of layers of ferromolybdenum alloy separated by intervening relatively narrow layers of residual slag.

Figure 4:
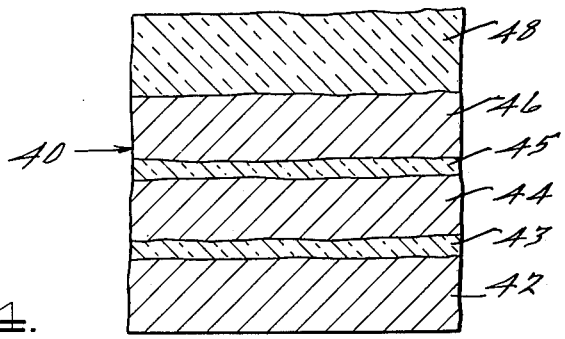
FIG. 4 is a transverse vertical sectional view of the multi-layered ingot as extracted from the crucible at the completion of the reaction and cooling cycle.

A multi-layered ingot 40, typical of that produced in accordance with the crucible arrangement shown in FIG. 3, is illustrated in FIG. 4 and comprises a bottom layer 42 of ferromolybdenum alloy, an intervening residual slag layer 43, an intermediate layer 44 of ferromolybdenum alloy, a second intervening residual slag layer 45, an upper ferro-alloy layer 46 and an upper slag cap 48. The multi-layered solidified ingot 40, upon cooling, is processed so as to remove the slag cap 48 and the three layers of ferromolybdenum alloy are separated by cleavage of the residual slag layers 43, 45, providing three ferromolybdenum alloy buttons. The residual slag present on the surfaces of the ferromolybdenum alloy buttons are removed mechanically or such as by sandblasting and the slag is preferably reprocessed to recover the metal values entrapped within the slag layer adjacent to the interface of the slag and ferro-alloy buttons. Alternatively, the recovered interfacial slag can be pulverized and recycled for use in the preparation of succeeding reaction mixtures.

The upper portion of the slag cap 48 can be discarded to waste, in that it is substantially devoid of any metal values and other valuable constituents of the reaction mixture. However, it is sometimes desirable to process the upper surface of the slag cap 48 due to the presence of scoria, comprising unreacted molybdenum trioxide which can advantageously be recovered and recycled for reuse. The ferromolybdenum alloy buttons are initially crushed, such as by dropping a skull-cracker ball, and the resultant pieces are thereafter fed to a jaw crusher for further size reduction, followed by a cone-type crusher and further milling operations to produce a powder, if desired.

The exothermic thermite smelting operation is performed by initially preparing a refractory-lined crucible, such as illustrated in FIG. 3, which is placed on a dolly cart and moved in position such that the dust collection chamber can be placed thereover. The reaction mixture of appropriate composition and quantity stored in a hopper 12, as shown in FIG. 1 is initially introduced to provide a small ignitable mixture in the base of the crucible. This initial charge can readily be ignited, such as by an electric spark, a hot wire, or an exothermic fuse comprised of sodium peroxide and aluminum powder, which is introduced in a form of a paper bag and is ignited by contact with water. The ignition of the initial charge progresses accompanied by the evolution of heat, whereafter additional reaction mixture is introduced through the chute 10, as shown in FIG. 1, at a controlled rate to maintain continuity of the exothermic reaction. As the reaction progresses with the continuous addition of further reaction mixture, a molten mass of ferromolybdenum alloy is formed in the base of the crucible, as illustrated in FIG. 2, over which a floating molten layer of slag is present.

When the level of the molten ferromolybdenum alloy approaches a position spaced below the slag-tapping spout 20 in the crucible, further addition of the reaction mixture is halted and the molten mass is permitted to stand for a sufficient time period to enable metallic droplets or prills to settle through the slag layer and enter the molten ferromolybdenum alloy. A dwell period between ½ to 2 hours is normally satisfactory for this purpose. At the conclusion of the dwell period, the refractory stopper 33 is removed, enabling drainage of the predominant portion of the molten slag from the upper stratum thereof from the crucible via the slag-tapping spout 20 exteriorly of the reaction chamber. The stopper thereafter is replaced and the hatch cover reaffixed to the collection chamber. A further cooling of the reaction mass may be required in order to effect a solidification of the ferro-alloy mass which generally occurs at a temperature of about 3200° F to about 3400° F, depending upon its specific composition. The residual slag layer having a substantially lower melting temperature, such as about 2000° F to about 2200° F, remains in a fluid condition. At the completion of the necessary cooling period, a second portion of reaction mixture is introduced directly on top of the residual slag layer remaining, and an ignition charge for the resumption of the thermite smelting operation.

While a portion of the residual slag layer remains between the adjacent ferro-alloy buttons produced and provides a stratum of reduced strength for effecting a cleavage of the ferro-alloy ingots, it is also contemplated that the residual slag layer can be modified by the addition of selected refractory materials thereto to effect still further improved separation of the multi-button ingots. The addition of such refractory materials can be achieved through the same chute 10, as shown in FIG. 1, to the residual slag layer at the conclusion of the slag-tapping operation, or to the molten slag cap at the conclusion of the settling period in the event no slag-tapping is to be performed. In either event, materials which have been found suitable as an addition agent to the slag layer to produce a barrier layer or parting agent include any one of a variety of refractory materials of the type which are compatible with the slag layer and do not adversely affect the ferromolybdenum alloy produced. Particularly satisfactory results are obtained utilizing acidic-type refractory materials such as silica and fire clay (aluminum silicate), as well as common brick itself, which are readily introduced in the form of bricks into the molten slag layer and which disintegrate and gravitate downwardly in the form of a stratum adjacent to the interface of the underlying ferromolybdenum alloy ingot.

It is also contemplated that such refractory materials can be introduced in the form of a sheet or blanket comprised of woven ceramic fibers which is cut to size corresponding substantially to the horizontal cross sectional configuration of the crucible. Ceramic sheets of the foregoing type composed of ceramic fibers consisting of alumina and silica are commercially available from Carborundum Company, of Niagara Falls, N.Y., under their trademark "Fiberfrax". When employing a sheet comprised of such ceramic fiber, the sheet is dropped over the open top of the crucible at the completion of the settling and cooling period and prior to the initiation of th next thermite reaction. In either event, the quantity of refractory material introduced is not critical and can vary from relatively small amounts which are effective to enhance cleavage between adjacent buttons up to amounts which do not undesirably increase the volume of the slag layer.

In spite of the turbulence of the exothermic reaction, a thin residual slag layer remains and as further material is introduced during the continuance of the reaction, a second molten layer of ferromolybdenum alloy is produced having a molten slag layer floating thereon. The addition of reaction material can again be interrupted in a manner as previously described, enabling a withdrawal of the predominant portion of the second slag layer after a suitable dwell period, followed by a resumption of the introduction of a third and further charge of reaction material. The addition of reaction mixture is stopped when the volume of the crucible has become filled, whereafter the predominant portion of the upper molten slag layer can also be drained, if desired, or simply retained and allowed to be solidified together with the underlying layer into a multi-layered ingot, such as the ingot 40 illustrated in FIG. 4. After solidification for a period of about 24 hours, the base plate 24 of the crucible is removed from the upper steel shell and the solidified multi-layered ingot and refractory lining is dropped. After a further period of cooling, the refractory lining is removed and the ingot separated to recover the ferromolybdenum buttons in a manner as previously described.

It will be appreciated that while in accordance with the preferred embodiment of the present process, a portion of the molten slag layer is withdrawn between intervening thermite reactions, substantial benefits can also be achieved in producing multi-layered ingots without resorting to any slag-tapping operation. Under conditions where no slat-tapping is performed, each thermite reaction is carried out for a period so as to produce an ingot or button within a thickness ranging from several inches up to about 1 foot thick, followed by a settling period and thereafter a cooling period to effect a solidification of the ferro-alloy mass. The high temperature of the molten slag cap ordinarily is sufficient to effect an ignition of the succeeding reaction mixture. The temperature and turbulence of the exothermic thermite reaction causes a portion of the molten slag cap to migrate upwardly and become displaced by the second ferro-alloy mass produced, such that the slag layer separating adjacent buttons of the multi-layered ingot even when no slag-tapping is performed is relatively thin. Under this operating procedure, the excessive quantity of slag retained in the crucible restricts the number of layers of ferro-alloy that can be accommodated and for this reason, the production of multi-layered ingots employing the slag-tapping technique is preferred.

In order to facilitate crushing of the ferro-alloy button produced at the conclusion of the cooling operation, it is also contemplated that the multi-layered ingots or the individual separated buttons can be subjected to a water-quench treatment while still at an elevated temperature which causes the crystallization of the surface stratum in fracture patterns. Such water-quench treatment also facilitates the cleavage and separation of buttons of a multi-layered ingot in such instances in which some interdiffusion bonding has occurred between adjacent buttons over a portion of the opposed areas therebetween. The water-quenching step can be achieved by simply submerging the button or multi-layered ingot in a tank of water for a period of time sufficient to effect the desired degree of cooling.

While it will be apparent that the invention as herein disclosed is well calculated to achieve the benefits and advantages set forth above, it will be appreciated that the invention is susceptible to modification, variation and change without departing from the spirit thereof.

What is claimed is:

1. A process for producing ferromolybdenum by a thermite smelting reaction which comprises the steps of forming a substantially uniform particulated mixture of molybdenum oxide, an iron bearing material, a reductant present in an amount substantially equal to the stoichiometric quantity required for reaction with the oxygen associated with said molybdenum oxide and said iron bearing material, and a slag fluxing agent, introducing a first portion of said mixture into a refractory crucible, igniting said first portion to effect an exothermic thermite reaction between said reductant and said molybdenum oxide and iron bearing material, progressively introducing a second portion of said mixture into said crucible to sustain said reaction forming a molten mass of said ferromolybdenum alloy having a first layer of slag floating on the upper surface thereof, interrupting the introduction of said mixture for a period of time to permit the migration of molten droplets of said ferromolybdenum alloy from said first slag layer into said molten mass, cooling said molten mass to effect a solidification thereof forming a first ferromolybdenum alloy button, progressively introducing a third portion of said mixture into said crucible on the molten slag layer to reinitiate and sustain said thermite reaction forming a second molten mass of ferromolybdenum alloy having a second slag layer thereon, cooling the reaction mass to effect a solidification of said second molten mass to form a second ferromolybdenum alloy button and second slag layer thereon, and thereafer extracting the solidified said reaction masses and separating said first and said second ferromolybdenum alloy button from said slag.

2. The process as defined in claim 1, including the further step after the interruption of the introduction of said mixture for a period of time to permit the migration of molten droplets of said ferromolybdenum alloy from said first slag layer into said molten mass of withdrawing the upper stratum of the molten said first slag layer from said crucible to effect a removal of the predominant portion thereof retaining a residual slag layer overlying the ferromolybdenum alloy interface.

3. The process as defined in claim 1, including the further steps after the cooling of the first and second molten mass to effect a solidification of the first and second ferromolybdenum alloy buttons of withdrawing the upper stratum of said first molten slag layer and said second molten slag layer from said crucible to effect the removal of the predominant portion thereof leaving a residual first slag layer and a residual second slag layer overlying the upper surface of said first ferromolybdenum alloy button and said second ferromolybdenum alloy button, respectively.

4. The process as defined in claim 1, in which the step of progressively inroducing a second portion of said mixture into said crucible is performed on a continuous basis and at a controlled rate to sustain said reaction at a controlled level.

5. The process as defined in claim 1, including the further step after the cooling of said molten mass to effect a solidification thereof forming a first ferromolybdenum alloy button to introduce a quantity of refractory material into the overlying molten said first slag layer effecting a disintegration thereof and a settling in the form of a layer adjacent to the interface of the underlying ferromolybdenum alloy button.

6. The process as defined in claim 1, wherein said reductant in said reaction mixture comprises a combination of silicon and aluminum present in a weight ratio of from 4:1 up to 10:1 parts silicon per part aluminum.

7. The process as defined in claim 1, including the further step of water-quenching the extracted and solidified said reaction masses while said first and said second ferromolybdenum alloy buttons are still at an elevated temperature to impart fracture patterns in the surface stratum thereof.

8. The process as defined in claim 5, in which said refractory material comprises an aluminum silicate fire clay material introduced in the form of agglomerated particles.

9. The process as defined in claim 5, in which said refractory material comprises ceramic fibers arranged in the form of a fibrous sheet which is positioned in overlying relationship on the molten slag layer.

10. The process as defined in claim 1, including the further steps after cooling said molten mass to effect a solidification thereof forming a ferromolybdenum alloy button of withdrawing the upper stratum of the molten slag layer from the crucible to effect a removal of the predominant portion thereof leaving a residual slag layer overlying the interface of the ferromolybdenum alloy button therebelow and thereafter introducing a refractory material into the residual slag layer in a manner to effect a disintegration thereof and a settling of the refractory material in the form of a layer overlying the interface of the underlying ferromolybdenum alloy button.

* * * * *